US011603689B2

(12) United States Patent
Dries

(10) Patent No.: US 11,603,689 B2
(45) Date of Patent: Mar. 14, 2023

(54) DOOR DEVICE AND METHOD FOR ALIGNING A DOOR DEVICE

(71) Applicant: Koen Dries, Zoersel (BE)

(72) Inventor: Koen Dries, Zoersel (BE)

(73) Assignee: Portapivot B.V., Zandhoven (BE)

( * ) Notice: Subject to any disclaimer, the term of this patent is extended or adjusted under 35 U.S.C. 154(b) by 532 days.

(21) Appl. No.: 16/609,763

(22) PCT Filed: Apr. 30, 2018

(86) PCT No.: PCT/IB2018/052983
§ 371 (c)(1),
(2) Date: Oct. 31, 2019

(87) PCT Pub. No.: WO2018/203213
PCT Pub. Date: Nov. 8, 2018

(65) Prior Publication Data

US 2020/0056411 A1 Feb. 20, 2020

(30) Foreign Application Priority Data

May 2, 2017 (BE) ..... 2017/5309

(51) Int. Cl.
*E05D 7/08* (2006.01)
*E05D 7/081* (2006.01)
*E05F 5/02* (2006.01)

(52) U.S. Cl.
CPC ..... *E05D 7/081* (2013.01); *E05F 5/02* (2013.01); *E05Y 2201/224* (2013.01);
(Continued)

(58) Field of Classification Search
CPC ..... E05F 1/1276; E05F 1/1246; E05F 1/1253; E05F 1/1261; E05F 1/1058; E05F 1/1075;
(Continued)

(56) References Cited

U.S. PATENT DOCUMENTS 1,668,839 A * 5/1928 Cureton ..... F16C 17/08 384/243
1,949,183 A * 2/1934 Thomas ..... E05D 7/0054 49/242
2,611,921 A * 9/1952 Gustaf ..... E05D 7/0415 16/244

(Continued)

FOREIGN PATENT DOCUMENTS

CH 262503 A 7/1949
CN 203201331 U * 9/2013

(Continued)

*Primary Examiner* — Chuck Y Mah
(74) *Attorney, Agent, or Firm* — N.V. Nederlandsch Octrooibureau

(57) ABSTRACT

The present invention relates to a door device for closing a door opening between two rooms of a building. The door device comprises a door leaf and a pivot hinge for pivotably suspending the door leaf in the door opening. The pivot hinge comprises a hinge foot which is attached to a hardening surrounding the door opening by means of wall attachment means. The pivot hinge furthermore comprises, for each wall attachment means, an insert with at least two pairs of parallel faces and a central opening which is eccentric with respect to the central axis, so that the orientation of the insert can influence the orientation of the door leaf in the closed position.

20 Claims, 6 Drawing Sheets

(52) U.S. Cl.
CPC ..... *E05Y 2201/46* (2013.01); *E05Y 2800/12* (2013.01); *E05Y 2800/268* (2013.01)

(58) Field of Classification Search
CPC ..... E05F 5/02; E05F 3/18; E05F 3/22; E05F 3/20; E05F 11/54; E05D 3/16; E05D 11/00; E05D 15/40; E05D 2003/163; E05D 3/06; E05Y 2201/10; E05Y 2201/256; E05Y 2201/21; E05Y 2201/264; E05Y 2201/47; E05Y 2201/492; E05Y 2900/20; E05Y 2900/202; E05Y 2600/10; E05Y 2600/41; A47B 2220/0072; Y10T 16/5383; Y10T 16/547; Y10T 16/5476
See application file for complete search history.

(56) References Cited

U.S. PATENT DOCUMENTS 3,895,412 A * 7/1975 Johnson ..... E05D 7/081 16/244
4,106,158 A * 8/1978 Kellems ..... E05D 7/0027 160/206
4,106,876 A * 8/1978 Tregoning ..... F16B 12/34 16/DIG. 34
4,677,707 A * 7/1987 Holler ..... E05D 7/0054 16/385
5,689,855 A * 11/1997 Tang ..... E05D 7/081 16/242
6,609,335 B1 8/2003 Hyakkoku
8,789,240 B2 * 7/2014 Bouwman ..... E05F 1/1253 16/334
9,140,045 B1 * 9/2015 Finkelstein ..... E05D 7/04
2019/0390493 A1 * 12/2019 Bacchetti ..... E05D 5/0246

FOREIGN PATENT DOCUMENTS

DE 10 2004 012 890 B3 7/2005
EP 0 541 877 A1 5/1993
EP 0652345 A1 * 5/1995
FR 2 703 098 A1 9/1994
WO WO-0184261 A1 * 11/2001 ..... E05D 7/0415

* cited by examiner

DOOR DEVICE AND METHOD FOR ALIGNING A DOOR DEVICE

The present invention relates to a door device for closing a door opening between two rooms of a building, according to the preamble of the first claim. The present invention furthermore relates to a method for aligning a door device.

PRIOR ART

Such door devices are known from the prior art. WO 2016/042525 discloses such a door device having a relatively large and/or a relatively heavy door leaf. Known door devices are configured for closing relatively large, frameless door openings with a door leaf which is correspondingly large. The weight of these door leaves results in relatively large forces being exerted on the hinges.

Furthermore, it is possible that, after the hinge foot has been attached to the hardening surrounding the door opening, the hinge foot is not correctly aligned. For example, if the hinge foot is attached by means of screws, it is possible for a small deviation to occur during the predrilling of a screw opening or the screwing in of the screw with respect to the desired position and/or direction of orientation. If the length direction of the hinge foot already makes a relatively small angle with the width direction of the door opening, this may result in a relatively large deviation at the location of the end of the door leaf.

Door hinges which make use of an insert for aligning or adjusting the position of the door leaf are known from U.S. Pat. No. 6,609,335 and CH262503.

DESCRIPTION OF THE INVENTION

It is an object of the invention to provide a door device which is more accurately aligned.

It is another object of the invention to provide a pivot hinge for a door device, by means of which the door device can be aligned more accurately and by means of which the aligned position can be more reliably ensured.

It is a further object of the invention to provide an improved method for aligning a door device.

In a first aspect, the invention relates to a door device for closing a door opening between two rooms of a building, the door device comprising a door leaf and a pivot hinge for suspending the door leaf in the door opening so as to be rotatable about a hinge pin S. The pivot hinge comprises a hinge foot which determines the orientation of the door leaf in a closed position of the door device, wherein the hinge foot comprises at least one recessed opening with side walls which extend in a length direction L of the hinge foot, and wall attachment means, provided to attach the hinge foot to a hardening surrounding the door opening, wherein a distal part of each wall attachment means extends through the recessed opening in the hardening and a proximal part is accommodated in the recessed opening.

For each wall attachment means, the pivot hinge furthermore comprises an insert which is accommodated in the recessed opening. The insert has a sleeve with at least two pairs of parallel faces whose width between the faces WAF (Width Across Flats) corresponds with a width W between faces of the recessed opening. As a result thereof, a pair of parallel faces of the at least two pairs of parallel faces bears against the faces of the recessed opening. In addition, the sleeve is designed so as to be rotationally symmetrical about a central axis M.

The insert comprises a central opening having a shape and size which corresponds to a shape and size of the proximal end of the wall attachment means. The central opening is eccentric with respect to the central axis M, so that the orientation of the insert influences the orientation of the hinge foot, and consequently the orientation of the door leaf in the closed position.

Due to the eccentric design of the central opening in the insert, it is possible to influence the orientation of the hinge foot with respect to the wall attachment means, without repositioning the wall attachment means, and thus influencing the orientation of the door leaf in the closed position.

In addition, an insert having a periphery with parallel faces, the width of which equals the width of the recessed opening, has the advantage that the door device according to the invention is able to resist lateral forces which are exerted on the hinge foot due to the hinges of the door leaf.

In embodiments according to the invention, the central opening is preferably cylindrical and the proximal end of the wall attachment means preferably has a flat underside. This has advantages, for example with respect to a cone-shaped opening, because lateral forces are only transmitted in directions at right angles to the direction of attachment and thus, no forces are transmitted which pull or push the wall attachment means out of the hardening. Consequently, this characteristic feature can contribute to making the pivot hinge more suitable for relatively heavy door leaves.

In embodiments according to the invention the central opening and the proximal end preferably have a relatively large depth and height, respectively, preferably at least 2 mm, more preferably at least 4 mm, such that the contact area between the two is relatively large, which can likewise contribute to better retention of the aligned position and/or a better suitability for relatively heavy door leaves.

In embodiments according to the invention, at least 10%, preferably at least 20%, of the sleeve surface bears against the faces of the recessed opening. The contact area between the insert and the hinge foot preferably has a width (measured along length direction L of the hinge foot) of at least 3 mm, more preferably at least 5 mm and/or a height (measured at right angles to length direction L of the hinge foot) of at least 3 mm, more preferably at least 5 mm. Due to the relatively large contact area between the insert and the hinge foot, the lateral forces can be transmitted virtually without the risk of the position of the hinge foot changing. This is important when using relatively heavy door leaves, because the lateral forces are correspondingly large, and providing the large contact area consequently makes the pivot hinge more suitable for such door leaves.

In another embodiment according to the invention, the insert comprises a visual indication, which is linked to the distance from a face of the sleeve up to an eccentric centre E of the central opening. The visual indication makes it easier to determine the orientation of the insert and consequently facilitates adjustment of the position of the hinge foot.

In a further embodiment according to the invention, the insert comprises visual indications for each pair of parallel faces and each visual indication is linked to the distance of one of both faces of the pair of parallel faces to the eccentric central opening.

In an embodiment according to the invention, a cross section of the insert has a hexagonal shape or an octagonal shape.

In an embodiment according to the invention, the wall attachment means is a screw, with the distal part comprising the threaded body of the screw and the proximal part comprising the head of the screw.

In an embodiment according to the invention, the pivot hinge comprises, on either side of the hinge pin, an elongate recessed opening directed along the length direction of the hinge foot with in each case an insert and a wall attachment means, as described above. This embodiment has the advantage that the position of the hinge foot can be adjusted in various ways, namely in the length direction (due to the elongate shape of the recessed openings), in the transverse direction (by changing the orientation of the inserts on either side in the same way) and in orientation (by changing the orientation of one of the inserts).

In another aspect according to the invention, optionally in combination with the other aspects described herein, the door device comprises a magnetic assembly for aligning the door leaf in a closed position of the door device. The magnetic assembly comprises a first part provided on an outer periphery of the door leaf and a second part provided on an inner periphery of the door opening. One part is provided with a permanent magnet and the other part is provided with an element which cooperates with the former magnetically. In the closed position of the door device, the first part and the second part coincide coaxially without touching each other. The magnetic assembly assists with the aligning of the door device in the closed position. On account of magnetic attraction, the first and second part will be attracted to each other and align the door leaf in the correct position.

In an embodiment according to the invention, the magnetic assembly comprises stopper means to prevent the door leaf from opening in one direction. These stopper means preferably form part of the first part and/or the second part.

In an embodiment according to the invention, the first part and the second part comprise stopper means and identical permanent magnets situated in the stopper means, wherein the stopper means bear against each other in the closed position of the door leaf. Preferably, the permanent magnets and the stopper means have a central opening and are attached to the door leaf and the hardening, respectively, by means of a screw through the central opening.

In a further aspect according to the invention, optionally in combination with the other aspects described herein, the door device comprises a sealing between the outer periphery of the door leaf and the hardening. This sealing comprises a base attached to the periphery of the door leaf and two flexible wing parts which are provided on either side of the base and extend from the sides of the base towards the centre and are shaped such that they collapse upon contact with the hardening, that is to say are moved towards the centre of the base. In the closed position of the door device, the flexible wing parts are thus bent due to the contact with the hardening. These wing parts may gradually seal an opening which is variable in size and is situated between the door device and the hardening.

BRIEF DESCRIPTION OF THE FIGURES

The invention will be explained in more detail below by means of an exemplary embodiment which is illustrated in the drawing, in which.

DETAILED DESCRIPTION

The present invention will be described below by means of well-defined embodiments and with reference to certain drawings, but the invention is not limited thereto and is only defined by the claims. The drawings illustrated here are only diagrammatic representations and are non-limiting.

Figure 1:
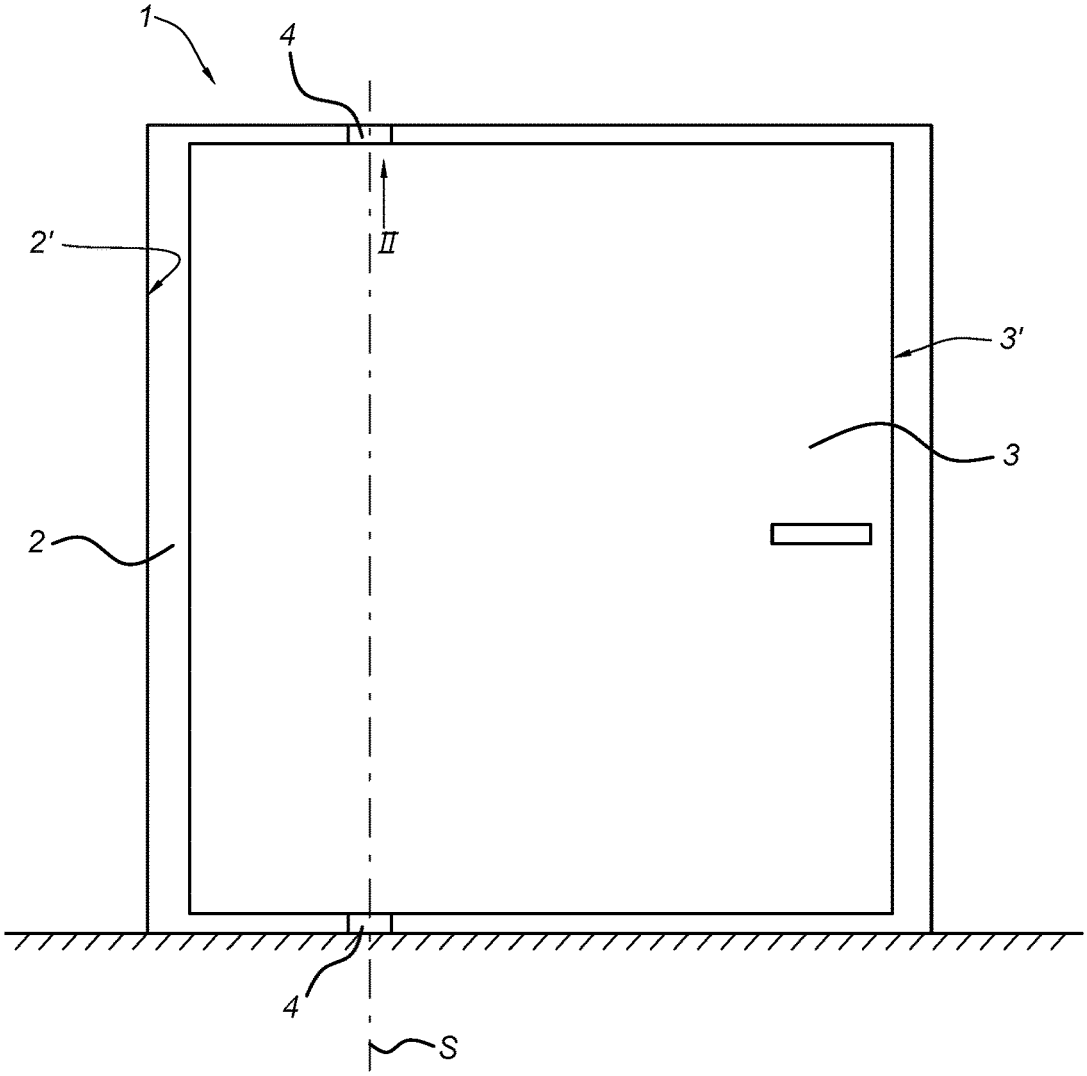
FIG. 1 shows a front view of a simplified representation of a door device according to an embodiment of the present invention.

FIG. 1 shows a front view of a simplified representation of a door device 1 according to an embodiment of the present invention. The illustrated door device 1 comprises a door leaf 3 which is pivotably suspended in a door opening 2 by means of a first pivot hinge 4 and a second pivot hinge 4. The first pivot hinge 4 and the second pivot hinge 4 define the hinge pin S about which the door leaf 3 is pivotably suspended.

Figure 2:
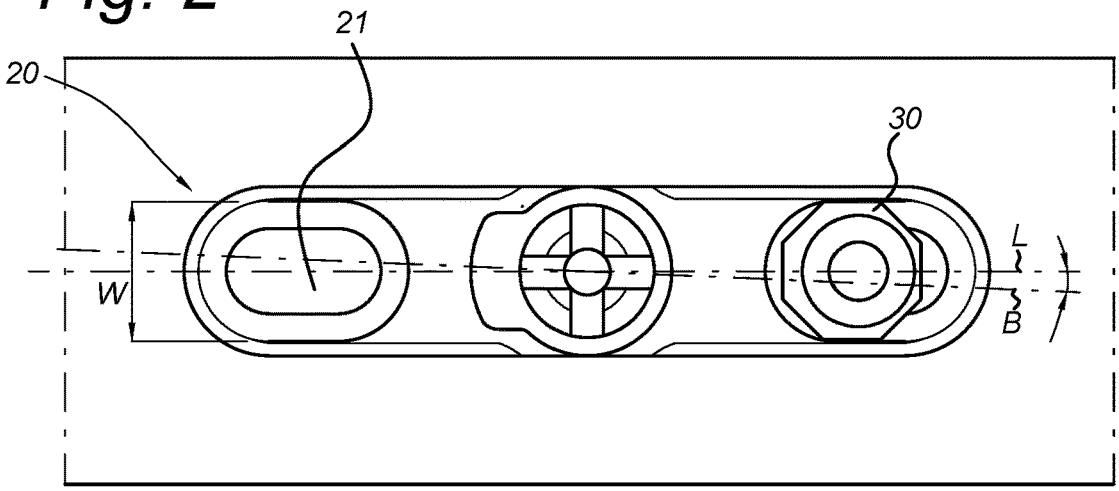
FIG. 2 shows a cross section through the door device shown in FIG. 1.

FIG. 2 shows a cross section through the door device 1 shown in FIG. 1, viewed from the door leaf 3. In this case, the cross section runs through the pivot hinge 4 along the length direction of the pivot hinge 4, as is also indicated by line II in FIG. 1. The pivot hinge 4 comprises a hinge foot 20, at least one insert 30 and screws 40, here also referred to as attachment means 40.

The hinge foot 20 is provided with a first recessed opening 21 and a second recessed opening 21 which extend in a length direction L of the hinge foot 20. The length direction L also determines the orientation of the door leaf 3 connected with the hinge foot 20 in a closed position of the door device 1 with respect to the width direction B of the door opening 2. Each recessed opening 21 is formed by a groove with a width W and an opening situated in the groove.

Each insert 30 (see FIG. 4) is provided with a sleeve 31 with a facetted periphery which has at least one first pair of parallel faces 32', 32" and a second pair of parallel faces 33', 33". In this case, the distance WAF between the faces in a pair 32', 32"; 33', 33" equals the width W of the recessed opening 21. Furthermore, the sleeve 31 is designed so as to be rotationally symmetrical about a central axis M. Each insert 30 is furthermore provided with a central opening 34. The central opening 34 is eccentric with respect to the central axis M.

The faces 32', 32"; 33', 33" preferably have a width of at least 3 mm, more preferably at least 5 mm, and preferably a height of at least 3 mm, more preferably at least 5 mm. The recessed opening 21 preferably has a depth of at least 3 mm, more preferably at least 5 mm. The height of the faces of the insert is preferably virtually equal to the depth of the recessed opening 21.

The screws 40 attach the hinge foot 20 to the hardening around the door opening 2. The screws 40 extend through the central opening 34 of the insert 30 and through the recessed opening 21 of the hinge foot. A distal part 41 of the screw 40 is situated in the hardening and is preferably provided with screw thread. A proximal part 42, also referred to as screw head 42, is accommodated in the central opening 34 of the insert 30 which is accommodated in the recessed opening 21 of the hinge foot 20. The shape and size of the screw head 42 correspond to the shape and size of the central opening 34. Both are preferably cylindrical, with a height and depth, respectively, of preferably at least 2 mm, more preferably at least 4 mm.

As a result of the reorientation of the insert 30, wherein a different pair of parallel faces bears against the hinge foot, the position of the hinge foot 20 with respect to the screws 40 will change. In this way, the alignment of the hinge foot 20 and the orientation of the hinge foot 20 can be corrected without having to reposition the screws 40.

Figure 3:
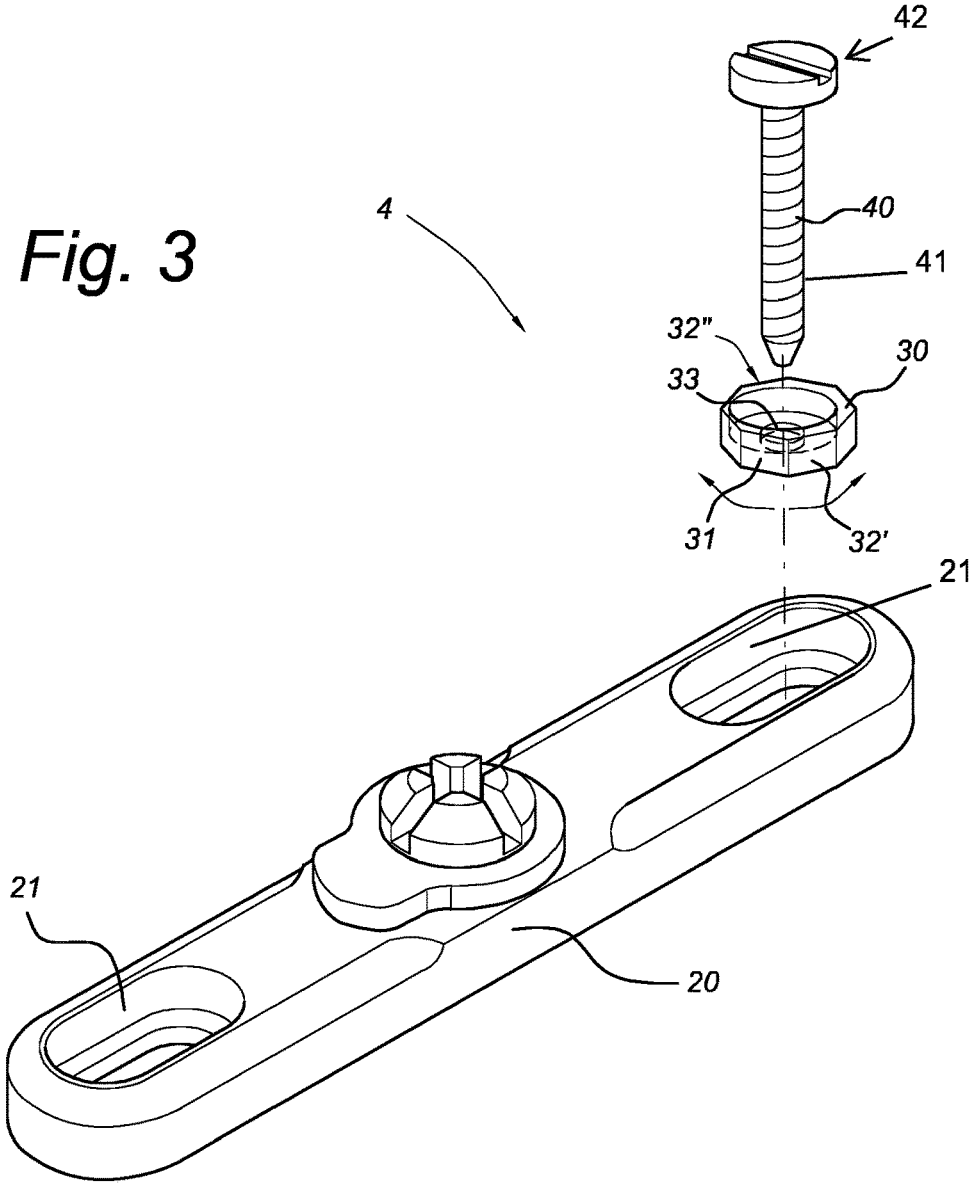
FIG. 3 shows a cut-away view of a part of a pivot hinge of a door device shown in FIG. 2.
Figure 4:
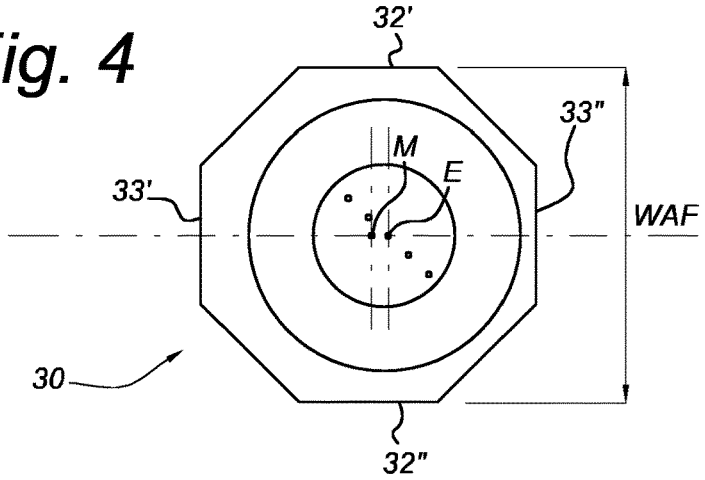
FIG. 4 shows a top view of an insert of the pivot hinge shown in FIG. 3.

FIG. 3 shows a cut-away view of a pivot hinge 4 of a door device 1 according to an embodiment of the present invention. The pivot hinge 4 comprises a hinge foot 20 with recessed openings 21, and an insert 30 and a screw 40 for each recessed opening. FIG. 4 shows a top view of the insert 30 of the pivot hinge 40 shown in FIGS. 2-3.

Figure 5:
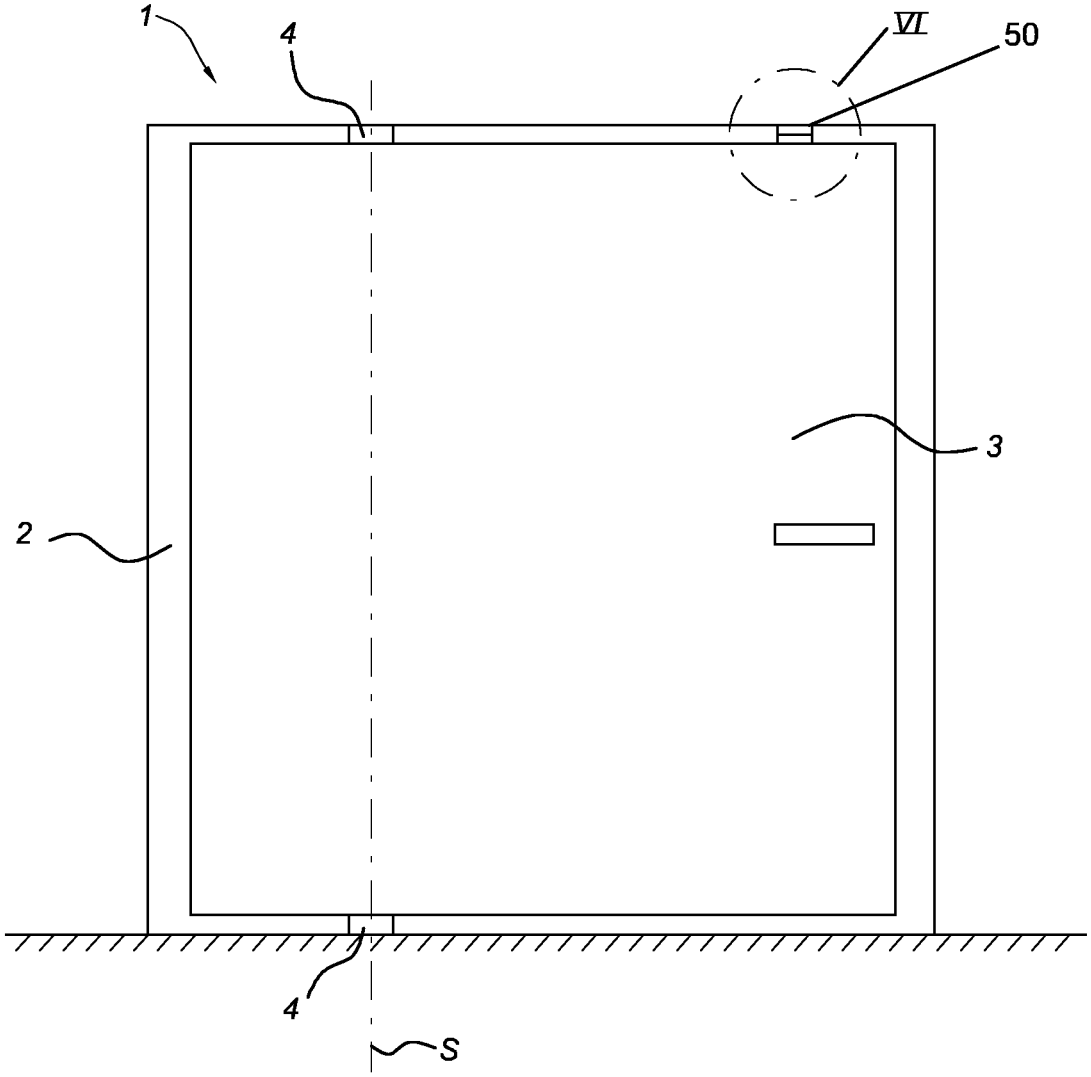
FIG. 5 shows a front view of a simplified representation of the door device shown in FIG. 1 and provided with a magnet assembly.
Figure 6A:
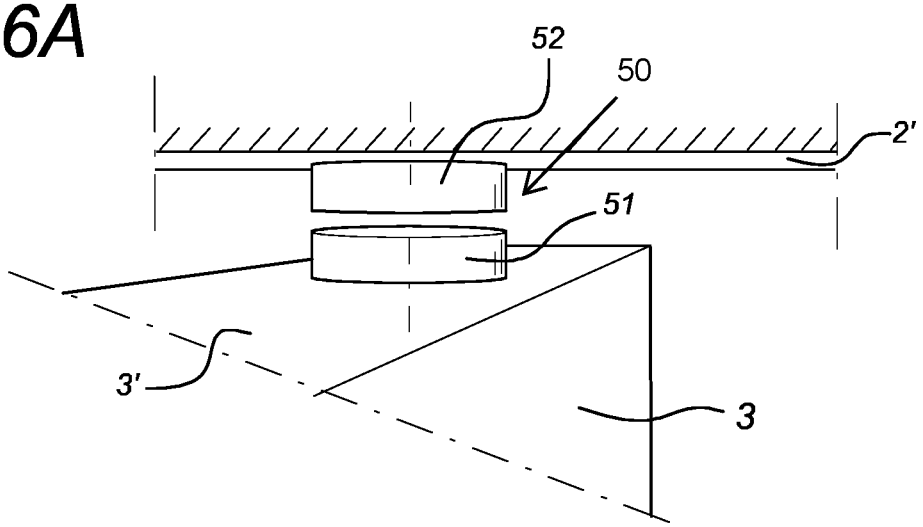
FIG. 6A shows a perspective view of a magnet assembly of the door device shown in FIG. 4.
Figure 6B:
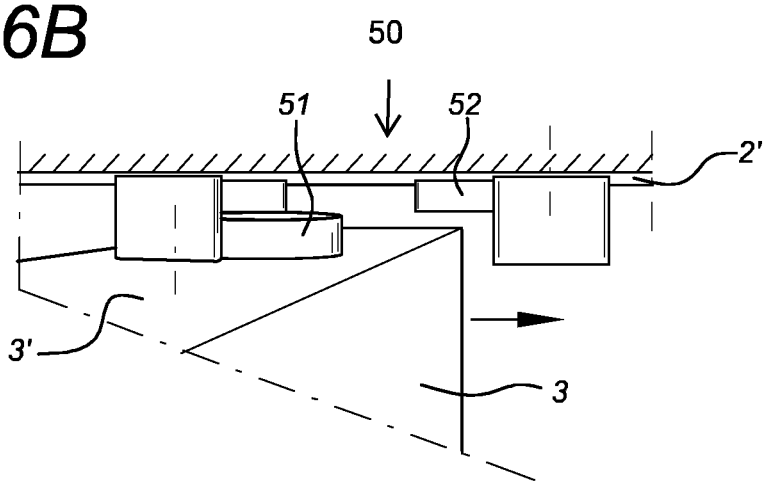
FIG. 6B shows a perspective view of a magnet assembly of the door device shown in FIG. 4.
Figure 7A:
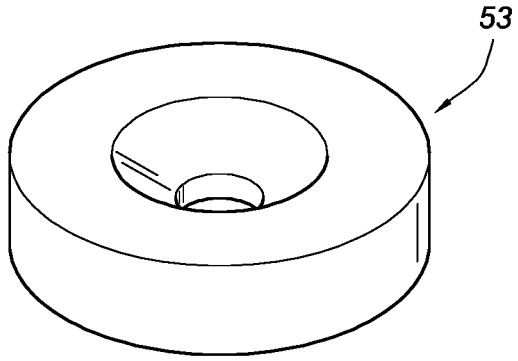
FIG. 7A shows a perspective view of a first or second part of the magnet assembly shown in FIG. 6A.
Figure 7B:
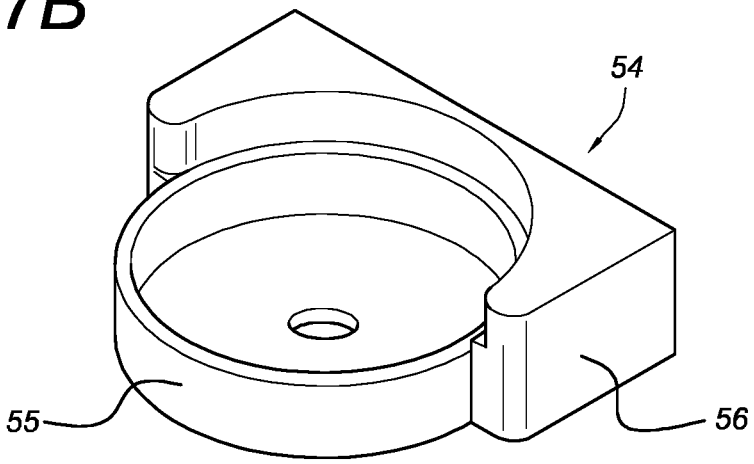
FIG. 7B shows a perspective view of a first or second part of the magnet assembly shown in FIG. 6B.
Figure 8:
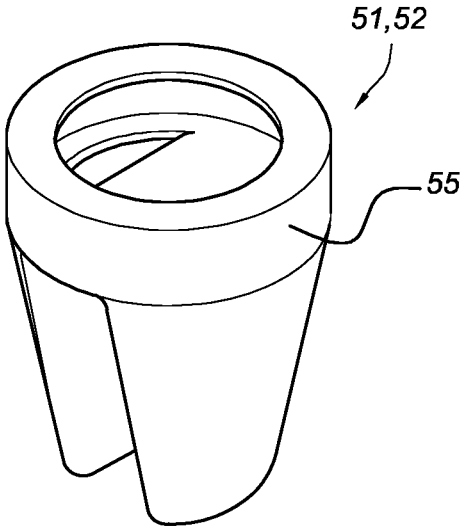
FIG. 8 shows a perspective view of a first part of the magnet assembly shown in FIG. 5.

FIG. 5 shows a front view of a simplified representation of the door device shown in FIG. 1 and provided with a magnet assembly 50. FIGS. 6A and 6B show diagrammatic views of magnet assemblies of the door device shown in FIG. 5. FIGS. 7A and 7B show perspective views of parts of the magnet assemblies shown in the preceding FIGS. 6A-6C. FIG. 8 shows a perspective view of a first part 51 of the door device shown in FIG. 5.

For the greatest part, the illustrated magnet assemblies 50 have the same shape and are assembled in the same way. The illustrated magnet assemblies 50 comprise a first part 51 provided on an outer periphery 3' of the door leaf 3 and a second part 52 provided on an inner periphery 2' of the door opening 2. The first part 51 is provided with a permanent magnet 53 and the second part 52 is configured to magnetically cooperate therewith, or vice versa. Both parts 51, 52 may be provided with a permanent magnet 53.

The illustrated magnet assemblies 50 differ in the way in which they can be rotated open and/or the way in which they are configured to be attached to an outer periphery 3' of a door leaf 3.

In the magnet assembly 50 shown in FIG. 6A, the first part 51 is provided on an outer periphery 3' of the door leaf 3 by means of a screw connection and the second part 52 is provided on an inner periphery 2' of the door opening 2 by means of a screw connection. The magnet assembly 50 is shown in a closed position of the door device 1, in which the first part 51 and the second part 52 coaxially coincide. As a result thereof, deviations with respect to the optimum alignment can be corrected by correctly positioning the magnet assembly 50. In addition, it is possible with this embodiment to open the door device 1 in two directions.

FIG. 7A shows a perspective view of a part 51; 52 of the magnet assembly 50 shown in FIG. 6A. The part 51; 52 comprises a magnet 53 with an attachment opening, through which screws may extend in order to attach the magnet 53 on the outer periphery 3' of the door leaf 3 or on the inner periphery 2' of the door opening 2.

Compared to the magnet assembly 50 shown in FIG. 6A, the magnet assembly 50 shown in FIG. 6B is further provided with stopper means 54. The stopper means 54 prevent the first part 51 and the second part 52 from being able to move over one another and further apart. As a result thereof, the direction of rotation of the door device is limited to a single direction and it is not possible, with this embodiment, to open the door device 1 in two directions.

Compared to the part 51; 52 shown in FIG. 7A, the first part 51 or second 52 shown in FIG. 6B is furthermore provided with a stopper means 54. FIG. 7B shows a perspective view of the stopper means 54 shown in FIG. 6B. The stopper means 54 is formed by a magnet holder 55 for receiving the permanent magnet 53 and a stopper element 56.

The permanent magnet 53 or an element magnetically cooperating therewith is provided in the magnet holder 55. In use, the stopper element 56 extends above the magnet holder 55 in order to prevent another part 51, 52 from being able to move past the permanent magnet 53 into the magnet holder 55. This other part 51, 52 may be an identical part with a stopper means 54 or the part 51; 52 shown in FIG. 7A formed by a permanent magnet 53 or an element magnetically cooperating therewith.

FIG. 8 shows a perspective view of a first part 51 of the magnet assembly 50 shown in FIG. 5. The first part 51 is configured as a magnet holder 55 with spring means and is configured to be provided on an outer periphery 3' of the door leaf 3 by means of a spring connection. By using a spring connection, it is possible to use the illustrated magnet assembly in combination with a relatively thin door leaf 3, such as for example a glass door leaf. In an embodiment (not shown), the first part 51 may furthermore be provided with stopper elements 56, as shown in the embodiment from FIG. 7B.

In use, the illustrated first part 51 may cooperate with a second part 52 according to FIG. 7A or according to FIG. 7B.

Figure 9:
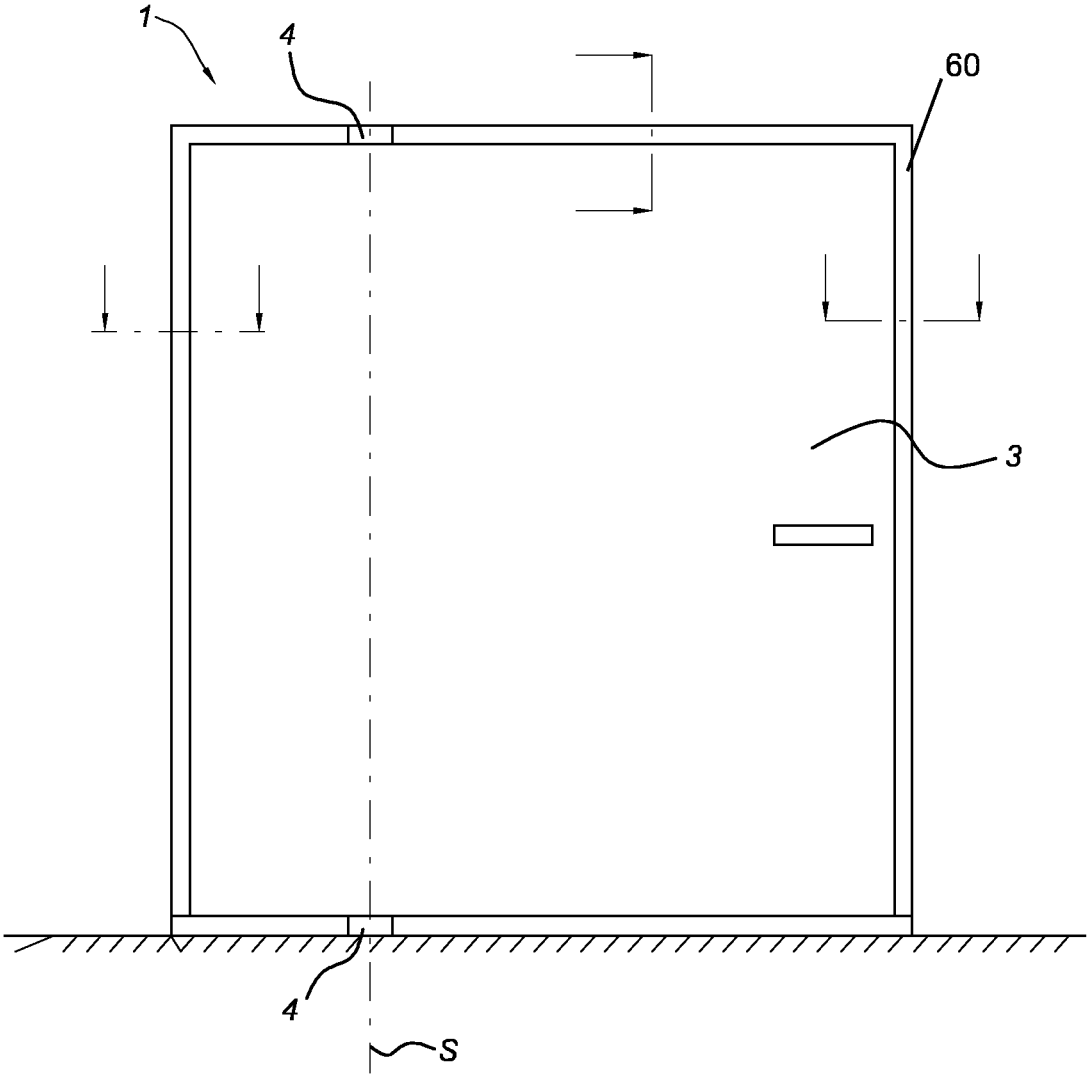
FIG. 9 shows a front view of a simplified representation of the door device shown in FIG. 1 and provided with a sealing.

FIG. 9 shows a front view of a simplified representation of the door device shown in FIG. 1 provided with a sealing 60. The sealing 60 is provided between the outer periphery 3' of the door leaf 3 and the hardening. The sealing 60 comprises a base 61 attached to the outer periphery 3' and two flexible wing parts 62 which extend from the base 62 along the length direction of the base 61 in a direction at right angles to the outer periphery 3'.

In the closed position of the door device 1, the flexible wing parts 62 seal the space between the outer periphery 3' of the door leaf 3 and the hardening. To this end, the flexible wing parts 62 are bent when the door device 1 is pivoted into the closed position. These flexible wing parts 62 can gradually seal an opening which varies along the length direction by plastically collapsing upon contact with the hardening.

Figure 10A:
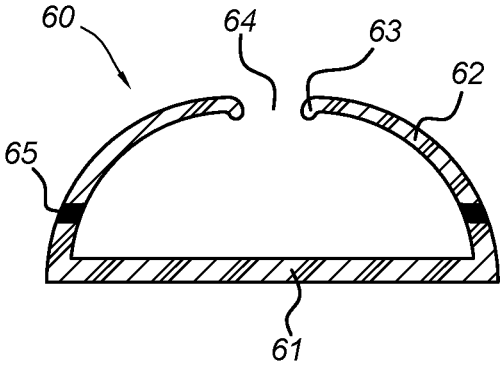
FIG. 10A shows a cross section through a sealing of the door device shown in FIG. 8.
Figure 10B:
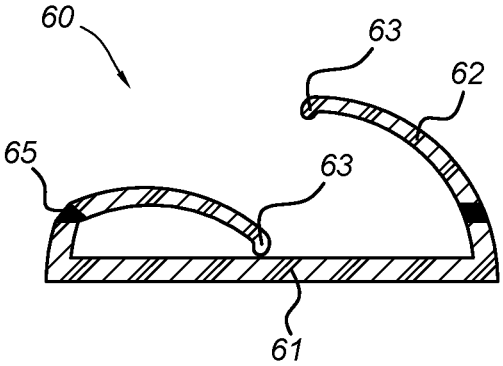
FIG. 10B shows the sealing shown in FIG. 9A.
Figure 11A:
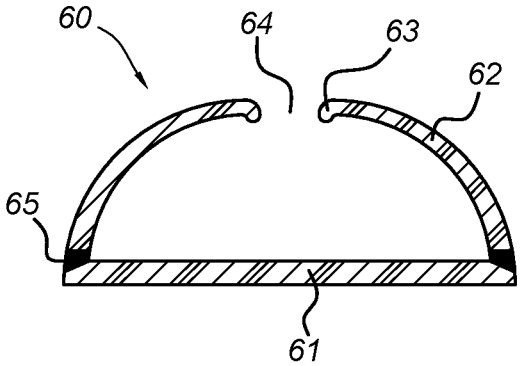
FIG. 11A shows a cross section through a sealing of the door device shown in FIG. 8.
Figure 11B:
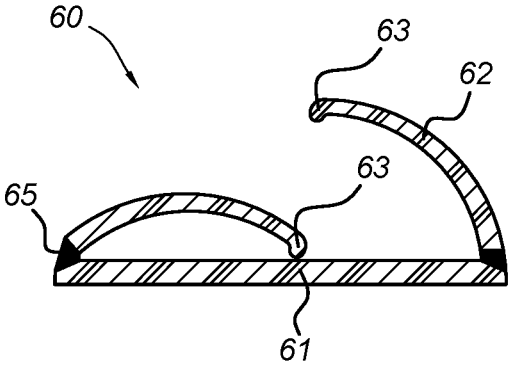
FIG. 11B shows the sealing shown in FIG. 10A.

FIGS. 10A and 11A show cross sections of the sealing 60 shown in FIG. 8. The illustrated sealings 60 differ in the way in which they hinge and/or where on the wing part 62 the hinge point is situated. FIGS. 9 and 10B show these respective sealings 60 with a flexible wing part in a minimal position and a flexible wing part in a rest position.

Two flexible wing parts 62 are provided on either side of the base 62. The wing parts 62 extend inwards. At the free end of each wing part, a projection 63 projecting towards the base is provided. In a rest position of both flexible wing parts, there is an opening 64 between the projections 63 of the two flexible wing parts 62. Upon contact with the hardening of the door opening, a flexible wing part 62 will plastically hinge about a hinge point 65. As a result thereof, the flexible wing 62 will, in the rest position, be deformed in the direction of the base. In the minimal position, the flexible wing 62 will be deformed/collapsed to the greatest extent and will be situated at a minimal distance from the base 61. As a result thereof, the sealing can seal an opening between the door leaf 3 and the hardening over a distance between the minimal distance and the rest position and along the entire length of the sealing 60.

LIST OF REFERENCE NUMERALS

1. Door device
2. Door opening
2'. Inner periphery of the door opening
3. Door leaf
3'. Outer periphery of the door leaf
4. Pivot hinge
20. Hinge foot
21. Recessed opening
30. Insert
31. Sleeve
32',32". First pair of parallel faces
33',33". Second pair of parallel faces
34. Central opening
40. Wall attachment means
50. Magnet assembly
51. First part
52. Second part
53. Permanent magnet
54. Stopper means
55. Magnet holder
56. Stopper element
60. Sealing
61. Sealing base
62. Sealing wing
63. Projection
64. Opening
65. Hinge point
H. Height direction of the door opening
B. Width direction of the door opening
D. Depth direction of the door opening
L. Length direction of the hinge foot
M. Central axis
E. Eccentric axis

The invention claimed is:

1. A door device for closing a door opening between two rooms of a building, the door device comprising:

a door leaf; and a first pivot hinge and a second pivot hinge for suspending the door leaf in the door opening so as to be rotatable about a hinge axis, wherein the first and second pivot hinges are respectively provided on opposite sides of the door leaf; the first pivot hinge comprising:

a hinge foot which determines the orientation of the door leaf in a closed position of the door device, wherein the hinge foot comprises at least one recessed opening with side walls which extend in a length direction L of the hinge foot;

at least one wall attachment member, provided to attach the hinge foot to a hardening surrounding the door opening, wherein a distal part of each said wall attachment member extends through the recessed opening into the hardening and a proximal part is accommodated in the recessed opening;

wherein the first pivot hinge further comprises an insert for each said wall attachment member which is accommodated in the recessed opening, wherein the insert comprises a sleeve with at least two pairs of parallel faces, which sleeve is designed so as to be rotationally symmetrical about a central axis M and whose width between each pair of the parallel faces (Width Across Flats, WAF) corresponds with a width W between the side walls of the recessed opening, as a result of which a pair of parallel faces of the at least two pairs of parallel faces bears against the side walls of the recessed opening, and wherein the insert comprises a central opening having a shape and size which corresponds to a shape and size of the proximal part, wherein the central opening is eccentric with respect to the central axis M, so that the orientation of the insert influences the orientation of the door leaf in the closed position; and wherein the central opening is cylindrical and the proximal part of the wall attachment member has a flat underside.

2. The door device according to claim 1, wherein at least 10% of the outer surface of the sleeve bears against the side walls of the recessed opening.

3. The door device according to claim 1, wherein contact areas which are formed by contact of the faces of the insert with the side walls of the recessed opening have a width of at least 3 mm, preferably at least 5 mm, and/or have a height of at least 3 mm, preferably at least 5 mm.

4. The door device according to claim 1, wherein the insert comprises a visual indication, which is linked to the perpendicular distance from a face of the sleeve to an eccentric axis E of the central opening.

5. The door device according to claim 1, wherein visual indications for each pair of parallel faces are provided and each visual indication is linked to the distance of one of both faces of the pair of parallel faces to the eccentric central opening.

6. The door device according to claim 1, wherein the wall attachment member is a screw.

7. The door device according to claim 1, wherein the first pivot hinge comprises two of said recessed openings located on either side of the hinge axis, wherein each recessed opening is an elongate recessed opening directed along the length direction L of the hinge foot.

8. The door device according to claim 1, wherein a cross section of the insert has a hexagonal shape or an octagonal shape.

9. The door device according to claim 1, wherein the door device comprises a magnetic assembly for aligning the door leaf in a closed position of the door device, in which a first part is provided on an outer periphery of the door leaf and a second part is provided on an inner periphery of the door opening, wherein one part is provided with a permanent magnet and the other part is provided with an element which cooperates with the former magnetically, wherein, in the closed position of the door device, the first part and the second part coincide coaxially without touching one another.

10. The door device according to claim 9, wherein the first part and/or the second part comprises a stopper device, wherein the stopper device is provided to prevent the door leaf from opening in one direction.

11. The door device according to claim 10, wherein each of the first part and the second part comprises a stopper device and comprises identical permanent magnets which are situated in the stopper device, wherein the stopper devices bear against each other in the closed position of the door leaf.

12. The door device according to claim 11, wherein the permanent magnets and the stopper devices have a central opening and are attached to the door leaf and the hardening, respectively, by means of a screw through the central opening.

13. The door device according to claim 1, wherein the door device comprises a sealing between the outer periphery of the door leaf and the hardening, the sealing comprising:

a base attached to the periphery of the door leaf; and two flexible wing parts which are provided on either side of the base and extend from the sides of the base towards the centre and are shaped such that they collapse upon contact with the hardening.

14. The door device according to claim 1, wherein the width of the door leaf is at least 100 cm.

15. The door device according to claim 1, wherein the weight of the door leaf is between 50-200 kg, preferably between 100-150 kg.

16. A method for aligning a door leaf of a door device according to claim 1, comprising the following steps:

orienting and placing each insert in each recessed opening of the hinge foot; and attaching the hinge foot to the hardening by means of the wall attachment member.

17. A pivot hinge for mounting a door leaf in a door opening, the pivot hinge comprising:

a hinge foot which determines the orientation of the door leaf when in a closed position in the door opening, wherein the hinge foot comprises at least one recessed opening with side walls which extend in a length direction L of the hinge foot;

at least one wall attachment member, provided to attach the hinge foot to a hardening surrounding the door opening, wherein a distal part of each said wall attachment member extends through the recessed opening into the hardening and a proximal part is accommodated in the recessed opening;

wherein the pivot hinge further comprises an insert for each said wall attachment member which is accommodated in the recessed opening, wherein the insert comprises a sleeve with at least two pairs of parallel faces, which sleeve is rotationally symmetrical about a central axis M and whose width between each pair of the parallel faces (Width Across Flats, WAF) corresponds with a width W between the side walls of the recessed opening, as a result of which a pair of parallel faces of the at least two pairs of parallel faces bears against the side walls of the recessed opening, and wherein the insert comprises a central opening having a shape and size which corresponds to a shape and size of the proximal part, wherein the central opening is eccentric with respect to the central axis M, so that the orientation of the insert influences the orientation of the door leaf in the closed position; and wherein the central opening is cylindrical and the proximal part of the wall attachment member has a flat underside.

18. The pivot hinge according to claim 17, wherein the first pivot hinge comprises two of said recessed openings located on either side of the hinge axis, wherein each recessed opening is an elongate recessed opening directed along the length direction L of the hinge foot.

19. The pivot hinge according to claim 17, wherein a cross section of the insert has a hexagonal shape or an octagonal shape.

20. The pivot hinge according to claim 17, wherein visual indications for each pair of parallel faces are provided and each visual indication is linked to the distance of one of both faces of the pair of parallel faces to the eccentric central opening.

* * * * *